US006888320B2

(12) United States Patent
Denes

(10) Patent No.: US 6,888,320 B2
(45) Date of Patent: May 3, 2005

(54) SWITCHING POWER SUPPLY FOR DISCHARGE LAMP AND METHOD FOR POWERING A LAMP

(75) Inventor: Alain Denes, Montigny le Bretonneux (FR)

(73) Assignee: Lempi SA, Reims (FR)

( * ) Notice: Subject to any disclaimer, the term of this patent is extended or adjusted under 35 U.S.C. 154(b) by 0 days.

(21) Appl. No.: 10/297,148

(22) PCT Filed: May 30, 2001

(86) PCT No.: PCT/EP01/06136

§ 371 (c)(1),
(2), (4) Date: May 30, 2003

(87) PCT Pub. No.: WO01/93379

PCT Pub. Date: Dec. 6, 2001

(65) Prior Publication Data

US 2003/0184242 A1 Oct. 2, 2003

(30) Foreign Application Priority Data

May 30, 2000 (WO) ..... PCT/FR00/01496

(51) Int. Cl.[7] ..... H05B 41/16

(52) U.S. Cl. ..... 315/274; 315/282; 315/278; 315/209 SC

(58) Field of Search ..... 315/291, 307, 315/276, 274, 278, 244, 209 SC, 360

(56) References Cited

U.S. PATENT DOCUMENTS

| | | | | |
|---|---|---|---|---|
| 3,837,332 A | | 9/1974 | Meyers | 128/2 R |
| 4,516,054 A | | 5/1985 | Shikama et al. | 315/71 |
| 4,523,128 A | | 6/1985 | Stamm et al. | 315/291 |
| 4,654,541 A | | 3/1987 | Angott | 307/147 |
| 4,691,341 A | | 9/1987 | Knoble et al. | 379/97 |
| 4,995,053 A | | 2/1991 | Simpson et al. | 375/1 |
| 4,998,095 A | | 3/1991 | Shields | 340/574 |
| 5,121,287 A | | 6/1992 | Lee | 361/331 |
| 5,237,264 A | | 8/1993 | Moseley et al. | 323/324 |
| 5,485,057 A | | 1/1996 | Smallwood et al. | 315/58 |
| 5,834,908 A | | 11/1998 | Boland et al. | 315/307 |
| 5,874,903 A | | 2/1999 | Shuey et al. | 340/870.02 |
| 5,886,738 A | | 3/1999 | Hollenbeck et al. | 348/151 |
| 6,046,551 A | * | 4/2000 | Kita | 315/307 |
| 6,124,680 A | * | 9/2000 | Shoji et al. | 315/291 |
| 6,194,845 B1 | * | 2/2001 | Konopka et al. | 315/291 |

FOREIGN PATENT DOCUMENTS

| | | |
|---|---|---|
| DE | 40 14 054 A1 | 11/1991 |
| EP | 0 430 358 A1 | 6/1991 |
| EP | 0 889 675 A1 | 1/1999 |
| WO | WO 97/31430 | 8/1997 |
| WO | WO 97/34272 | 9/1997 |
| WO | WO 98/13945 | 4/1998 |

OTHER PUBLICATIONS

Revised version of International Search Report for International Application No. PCT/EP01/06136 (mailed on Jan. 2, 2002).

* cited by examiner

*Primary Examiner*—Tuyet Thi Vo
(74) *Attorney, Agent, or Firm*—Welsh & Katz, Ltd.

(57) ABSTRACT

The invention concerns a method for powering a discharge lamp with a switching power supply. Said method is characterised in that it consists in: applying a voltage firing the lamp, then after the lamp has been energized, applying a lower service voltage to the firing voltage. The firing and service voltages can be generated by using a resonant circuit at the terminals of which a chopped voltage is applied with different frequencies. The invention also concerns a light source comprising a discharge lamp and a switching power supply. Said light source can be equipped with devices for measuring several parameters, such as power, light intensity or the amplitude of vibrations. The invention is useful for producing public lighting.

17 Claims, 4 Drawing Sheets

SWITCHING POWER SUPPLY FOR DISCHARGE LAMP AND METHOD FOR POWERING A LAMP

BACKGROUND OF THE INVENTION

The invention relates to a switch mode power supply for a discharge lamp and a method of powering the lamp.

At present, there is no simple, effective and economic solution for controlling the startup and managing the ignition of a discharge lamp, especially a lamp for a lighting column or street lamp.

SUMMARY OF THE INVENTION

The invention provides a solution to one or more of these problems. Thus, the invention provides a method for powering a discharge lamp with a switch mode power supply, comprising the steps of applying a lamp startup voltage to the lamp, and after starting the lamp, of applying a service voltage lower than the startup voltage.

According to one embodiment, the switch mode power supply comprises a resonant circuit supplying the lamp, the resonant circuit provides the startup voltage to the lamp when a voltage chopped at a first frequency is applied thereto and provides the service voltage to the lamp when a voltage chopped at another frequency is applied thereto.

According to another embodiment, the service voltage is applied to the lamp after a specific duration of startup voltage application or when a threshold of current flowing through the lamp is reached or when a threshold of light intensity of the lamp is reached.

The invention further relates to a light source comprising a discharge lamp, and a switch mode power supply powering the discharge lamp.

According to one embodiment, the switch mode power supply supplies the lamp selectively with at least one startup voltage and with a service voltage lower than the startup voltage.

According to another embodiment, the switch mode power supply supplies the lamp with the service voltage after startup.

According to another embodiment, the switch mode power supply comprises means for determining the end of startup as a function of the duration of startup voltage application, as a function of the current flowing through the lamp or as a function of the light intensity emitted by the lamp.

According to another embodiment, the switch mode power supply further comprises a resonant circuit, for example an LC circuit, providing the startup voltage to the lamp when a voltage chopped at a first frequency is applied thereto and providing the service voltage to the lamp when a voltage chopped at another frequency is applied thereto.

Furthermore, provision can be made for a light source in which the switch mode power supply further comprises voltage chopping means, a transformer supplied by the chopping means and having a first output providing the startup voltage, a second output supplying the service voltage, and means for selectively applying the startup voltage and the service voltage to the lamp.

According to one embodiment, the switch mode power supply further comprises a transceiver (transmitter/receiver) controlling the ignition and/or extinction of the lamp.

According to another embodiment, the switch mode power supply further comprises a control circuit carrying out at least one of the following measurements: measurement of the electric current consumed by the lamp, measurement of the external temperature or of the control circuit, measurement of the external brightness, measurement of the phase shift between current and voltage supplying the lamp, measurement of external vibration, and measurement of external shock, the control circuit preferably comprising a memory for storing one or more of the measurements carried out.

According to yet another embodiment, the transceiver transmits the measurements of the control circuit.

Other features and advantages of the invention will become apparent in the following description of a preferred embodiment of the invention, given by way of example and with reference to the appended drawings.

DETAILED DESCRIPTION OF PREFERRED EMBODIMENTS

Figure 1:
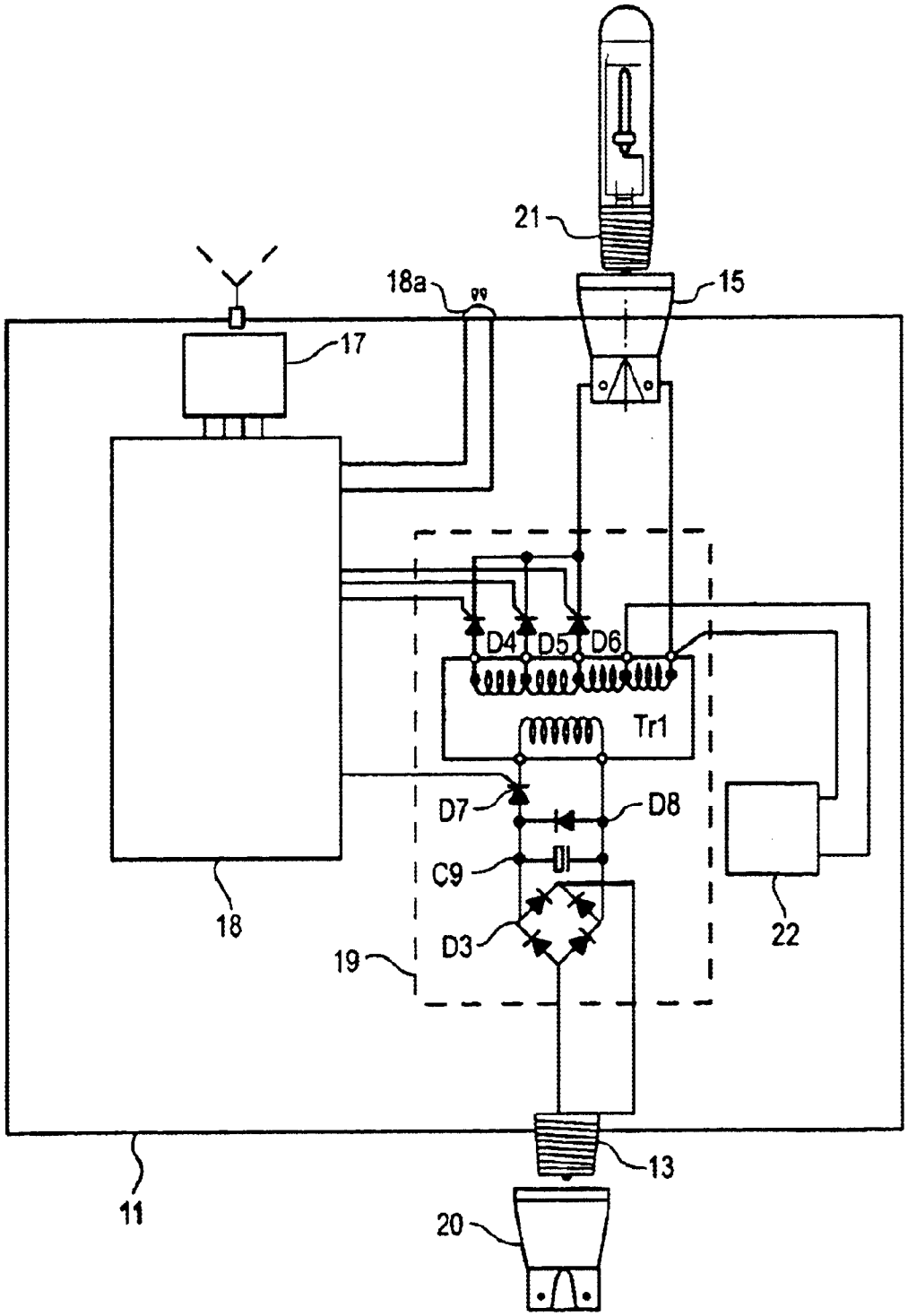
FIG. 1 shows a circuit diagram of a lamp adapter socket for a lighting column according to a first embodiment of the invention.

FIG. 1 illustrates a lamp adapter socket 10 of a lighting column 1 according to the first embodiment of the invention. The lighting column comprises a bulb 21 of the electrical discharge lamp type. This bulb is connected to a socket 15. The terminals of socket 15 are connected to a control unit 18.

The lighting column control unit or module 18 may in particular fulfill one or more of the following functions:

- controlling the ignition or the extinction of the lamp of the lighting column 1;
- managing the startup of the lamp;
- varying the supply power delivered to the lamp;
- measuring the electric current consumed by the lamp;
- determining the phase shift between the current and the voltage (cos $\phi$);
- compensating for the phase shift between the current and the voltage (cos $\phi$);
- measuring the brightness of the lamp;
- measuring the temperature outside or inside the electronic module.

These functions may be implemented in a manner known per se.

The module 18 for controlling the lighting column could also store the data measured in this way in its memory.

The control unit may control a switch mode power supply 19. A first embodiment of the switch mode power supply is shown in FIG. 1. The input of the switch mode power supply 19 is connected to a diode bridge D3 in order to rectify the current. Preferably, a smoothing capacitor C9 and a Zener diode D8 are connected in parallel to the outputs of the diode bridge D8 in order to smooth and stabilize the rectified voltage. The rectified voltage, possibly smoothed and stabilized, is applied to the primary winding of a transformer Tr1 via a controlled switch D7 in order to chop, at high frequency, the voltage applied to the primary of the transformer Tr1. The controlled switch D7 is, in this case, a thyristor but this could also be a power transistor or any other suitable component. The transformer Tr1 has a secondary winding with several outputs, each delivering a different voltage. The three first outputs of the winding are each connected, via a respective controlled switch D4, D5, D6, to the output of the switch mode power supply 19, that is to say to the socket 15 intended to receive the bulb 21. The controlled switches D4, D5, D6 are of a type similar to the switch D7.

The switch mode power supply 19 is particularly suitable for powering a bulb 21 of the electrical discharge lamp type, and more particularly, of the mercury vapor or sodium vapor lamp type.

For this, the input of the switch mode power supply 19 is supplied, for example, by a line voltage of 230 V. The switch D7 is switched to a high frequency of between about 30 kHz and 90 kHz. In our example, the frequency is 60 kHz. The chopped signal thus obtained is applied to the primary winding of the transformer Tr1.

The secondary winding of the transformer Tr1 has a first output—that corresponding to the switch D4—which delivers enough voltage to cause the startup of the lamp. In our example, this voltage is 600 V.

The secondary winding of the transformer Tr1 has a second output—that corresponding to the switch D5—which delivers a voltage corresponding to the nominal service voltage of the lamp. In our example, this voltage is 100 V.

The secondary winding of the transformer Tr1 may in addition have a third output—that corresponding to the switch D6—which delivers a voltage corresponding to a voltage slightly lower than the service voltage of the lamp, but enough to keep the lamp ignited. In our example, this voltage is 90 V.

To start the lamp, the switch D4 is closed and the switches D5 and D6 are kept open. When the lamp is started, the switch D5 is closed while the switch D4 is opened so as to apply the nominal service voltage to the lamp. Several methods may be used to determine whether the lamp has started up:

either by the passage of a fixed time since the start of applying the startup voltage—that is to say since closing the switch D4;

or as a function of the current consumed by the lamp which can be determined by a conventional current-measuring circuit from which the control module 18 can control the switches D4 and D5;

or as a function of the brightness detected by a light meter. For example, it is possible to place a light meter close to the bulb in order to determine the light intensity emitted by the lamp. The control module may, for example, determine whether the startup is completed beyond a certain brightness threshold.

If it is desired to decrease the brightness produced by the lamp, the switch D6 is closed while the switch D5 is opened so as to apply the voltage which is slightly lower than the nominal service voltage to the lamp.

A person skilled in the art will understand that the third output of the secondary winding is optional. On the other hand, it is also possible to have several outputs at the secondary winding, each one delivering a respective voltage located within the nominal operating voltage range of the lamp or service range.

The switch mode power supply 19 is advantageously controlled by the control module 18 in order that the bulb 21 may or may not be supplied and/or to vary the power delivered to the bulb 21.

The use of a switch mode power supply to power a discharge lamp has several advantages:

it makes it possible to do without lamp accessories such as the starter and the ballast currently used and which have a weight and a volume greater than the switch mode power supply;

a switch mode power supply can be placed in a lamp adapter socket, detailed hereinbelow, while the existing starter and ballast are too bulky and heavy;

the steep voltage edges provided by the switch mode power supply facilitate startup of the lamp;

the high chopping frequency prevents the lamp from flickering.

Figure 2:
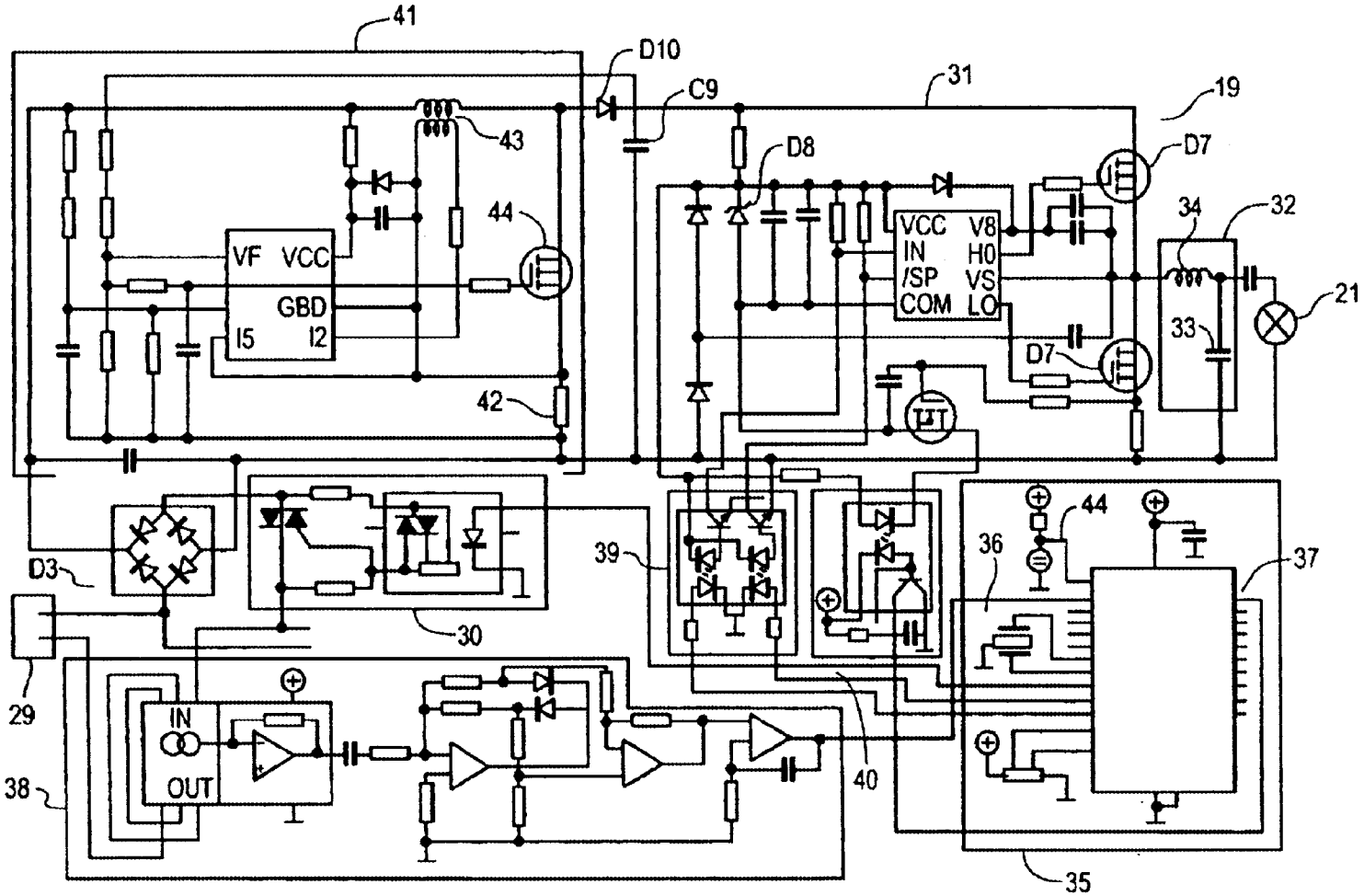
FIG. 2 illustrates a circuit diagram of another embodiment of a lamp adapter socket according to one aspect of the invention.

FIG. 2 illustrates another embodiment of a switch mode power supply 19. In a general manner known per se, the logic circuits are powered by voltages of 5 V, some of which are not shown for the sake of clarity. This switch mode power supply comprises a circuit 31 providing a chopped voltage. For this, it is possible, as in the first embodiment, to use one input of the switch mode power supply 19 connected to a diode bridge D3 in order to rectify the current. This diode bridge may, for example, be connected to a mains power supply 29. A general switch 30 can be used to establish or interrupt the general supply of the bulb 21. The switch may, for example, be controlled by the control circuit 35 detailed hereinafter. It is also possible to connect a smoothing capacitor C9 and a Zener diode D8 in parallel with the outputs of the diode bridge D8 in order to smooth and stabilize the rectified voltage.

The rectified voltage, possibly smoothed and stabilized, is applied to a resonant circuit 32 via controlled switches D7 in order to chop, at a high frequency, the voltage applied to the terminals of the resonant circuit 32. The switches D7 may be controlled by a microcontroller of the IR2104 type. The resonant circuit 32 described here is of the LC type. It is of course possible to use any type of suitable resonant circuit. The bulb 21 is connected to the terminals of the capacitor 33 of the resonant circuit.

Figure 3:
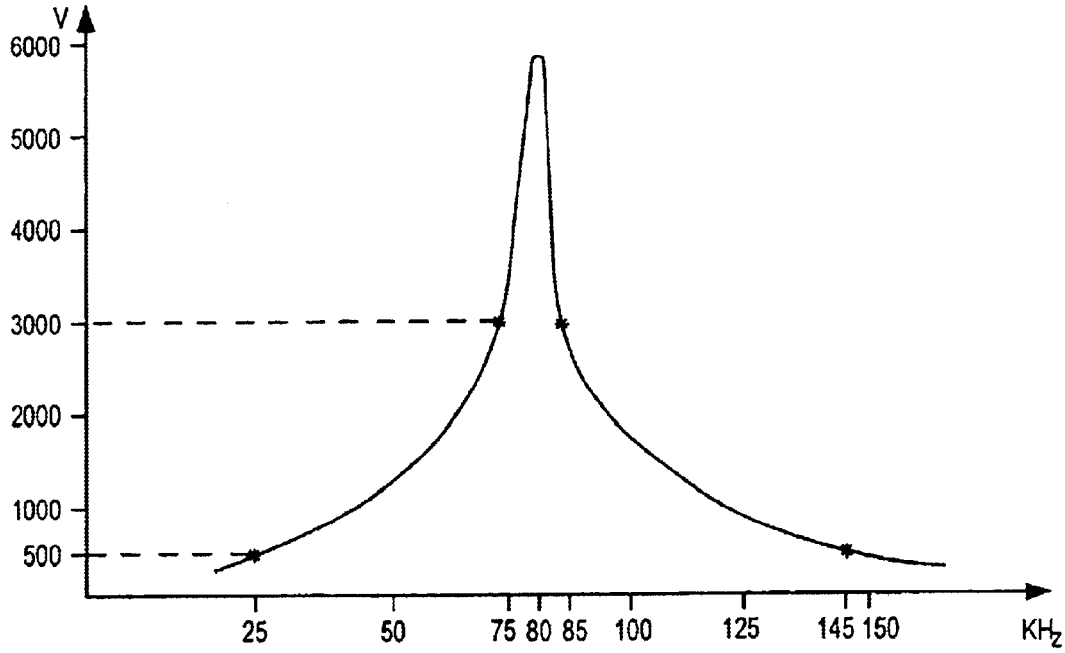
FIG. 3 illustrates the frequency response curve of a resonant circuit of the example of FIG. 2.

To supply the bulb at the appropriate voltage as a function of its startup or service operating phase, the frequency response curve of the resonant circuit is used. FIG. 3 illustrates an example of a frequency response curve of a resonant circuit which can be used for the power supply circuit. It is for example possible to use a resonant circuit 32 with a 20 nF capacitor 33 and a 0.2 mH inductor 34. In general, a person skilled in the art will determine the appropriate components for the specific bulb voltages. For a given chopping frequency at the input of the resonant circuit, a corresponding voltage at the terminals of the capacitor is obtained. This type of power supply may in addition be used with various types of bulb without having to be changed. It is then enough to alter the adjustments by altering, for example, the chopping frequencies used.

The chopping frequencies may be obtained using a control circuit 35. This control circuit 35 comprises, for example, a microcontroller, such as the PIC18C2X2 model. This microcontroller is connected at one of its terminals to an oscillator 36. The oscillator 36 may for example selectively provide two pulsed frequencies corresponding to the service and startup chopping frequencies.

The control circuit 35 is preferably connected to the circuit providing the chopped voltage via an optocoupler 39. Thus it is possible to galvanically isolate the control circuit from the chopper circuit. The circuit providing the chopped voltage actuates the switches D7 at the frequency provided thereto by the control circuit 35.

According to one method of powering the bulb, the resonant circuit is initially supplied with a voltage chopped at a given frequency with which a bulb startup voltage corresponds. In the example of FIG. 3, in order to obtain the startup voltage of 3000 V, the resonant circuit is supplied at a frequency of about 85 kHz or 75 kHz. In general, the resonant circuit is dimensioned such that the voltage of the resonant peak of the circuit is greater than the startup voltage. In the example of the FIG., there is a resonant peak of 6000 V at a frequency of 80 kHz. The startup voltage may be kept for a predetermined time, or kept until a predetermined current value is obtained, or else kept until a predetermined light intensity is obtained, as has been described above.

The frequency of the chopped voltage supplying the bulb is then changed. A chopping frequency making it possible to obtain a service voltage at the terminals of the bulb is then used. This service voltage is less than the startup voltage. In the example of FIG. 3, in order to obtain a service voltage of about 500 V, the resonant circuit is supplied at a frequency of 25 kHz or 145 kHz. A chopping frequency of about 150 kHz can be used in order to limit the flickering or the fluttering of the bulb.

Preferably, a startup chopping frequency and a service startup frequency placed on the same side of the resonant peak are used. In the example of FIG. 3, a startup frequency of 85 kHz in combination with a service frequency of 145 kHz or a startup frequency of 75 kHz in combination with a service frequency of 25 kHz will thus be used. The switching time between the startup voltage and the service voltage is thus reduced. A transition between startup and service at a frequency providing a resonant peak voltage is also avoided. The bulb life is thus increased.

Of course, it is possible to vary the service light intensity by using a service chopping frequency range. It is then possible to use various chopping frequencies within this range. For example, it is possible to decrease the power consumed by the bulb, which proportionally increases the life of this bulb. It is also possible to alter the chopping frequency in order to alter the color emitted by the bulb. For example, it is possible to switch between a first service frequency and a second service frequency in order to alter the illumination color. With a supply of this sort, it is possible to obtain two illumination colors for a given light intensity.

It is possible to provide a control loop 38 in order to regulate the bulb current. For this, it is possible for example to use a feedback loop by introducing the measured current and slaving it to a reference current. The current can be adjusted by altering the chopping frequency. It is also possible to use a light meter to carry out slaving to a reference light intensity. For example, it is possible to place the light meter far enough away from the bulb in order also to take account of the surrounding light intensity. This regulation makes it possible, for example, to remove the fluctuations from the line supply. The life of the lamp and of the bulb is thus considerably increased. A component of the LST6NP type can be used for the control loop 38.

It is also possible to control chopping frequency errors. For example, it is possible to use a circuit 40, connecting the chopping circuit 31 to the control circuit 35. This circuit may, for example, send an error signal to a pin of the microcontroller 37, should the chopping frequency go outside a specific frequency range. The microcontroller may then call for a corrected oscillation frequency from the oscillator 36.

Provision may also be made to integrate a circuit 41 compensating for cos ϕ into the switch mode power supply. For this, it is possible to use cos ϕ compensation circuits known per se, such as the Motorola MC33262. Generally, the supply intrinsically has a cos ϕ very much less than 1, due to the use of coils and capacitors. A compensation circuit makes it possible to bring the cos ϕ of the supply close to a value of 1. The lamp supply may thus comply with various legislation relating to current interference and harmonics.

The cos ϕ compensation circuit is connected to the rectified voltage terminals of the rectification circuit D3. The cos ϕ compensation circuit may measure the shape of the rectified current via a transformer 43. Depending on the shape of the measured current, the cos ϕ compensation circuit actuates the switch 44 in order to smooth the current. The cos ϕ compensation circuit may also include a shunt 42 for measuring the current consumed by the bulb. Although the cos ϕ compensation circuit described above is of the active type, it is of course possible to use a passive compensation circuit.

To obtain a constant chopped voltage independently of the line voltage cycles, it is possible to use a transductance error amplifier in the cos ϕ compensation circuit. This circuit is connected to a single quadrant multiplier circuit so as to form a compensation loop. It is possible to incorporate an overvoltage comparator into the amplifier in order to remove voltage peaks when switching on the lamp or during charge suppression. Thus, the production of electric arcs in the lamp and interference in the feedback loop are also limited.

The cos ϕ compensation circuit 41 may be connected to the chopping circuit 31 via a diode D10. The cos ϕ compensation circuit is thus protected from any malfunction of the chopping circuit.

Where the lighting column control unit has means for measuring the electric current consumed by the lamp, it may advantageously cut off the supply to the lamp of the lighting column 1 in the event of a measured overload in order to make the lighting column safe. In this case, it is preferable that the switching back on of the lamp is either manual or requires a command sent to a lighting column control module, for example, by a monitoring station. Communication with the monitoring station may, for example, be carried out by means of a transceiver (transmitter/receiver) 17 integrated into the lamp adapter socket or into the lighting column.

The lighting column or the lamp adapter socket may comprise a shock or vibration sensor 44. The sensor may be connected to the control unit. The control unit may then be parameterized in order to interrupt the bulb supply when a shock or vibrations exceeding a predetermined threshold are detected. It is, for example, possible to momentarily cut off the lamp while vehicles generating large vibrations pass by. Thus it is possible to increase the life of the lamp and of the socket. The shock or vibration sensor is known per se. These functions may be implemented in a manner known per se. It is preferable to connect the socket of the bulb or the switch mode power supply to the lamp casing via one or more suitable "silent-blocs" or dampers. In this way, the bulb is better isolated from any external vibrations. It is then preferable to mount the vibration sensor 44 in the dampened region of the lamp, for example inside the control circuit 35 or in another suitable location in the switch mode power supply 19.

Additional circuits, such as shock detection or intensity measurement circuits, may in addition be connected to a microcontroller of the control unit by means of galvanic isolation optocouplers.

The lighting column supply circuit may be supplied by a power cabinet. The supply circuit can be turned on/off by the power cabinet as a function of the ambient light or as a function of internal timetable programs. A cabinet control module may also be provided, for example for storing data determined by the operating sensors, such as the intensity or shock sensors, in its memory.

Finally, it is obvious that a switch mode power supply 19 of this sort is not necessarily placed inside a lamp adapter socket. It could for example be housed directly in the lighting column.

Figure 4:
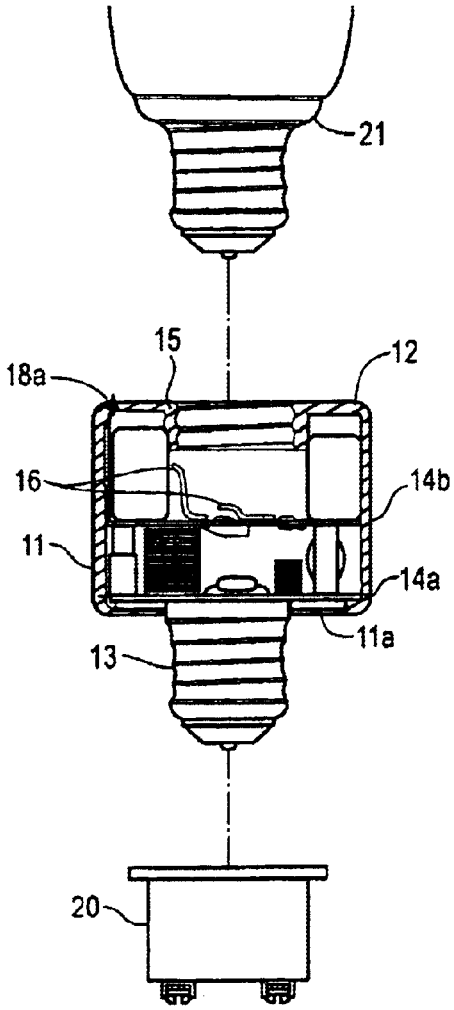
FIG. 4 illustrates a lamp adapter socket in section.

We will now describe a lamp adapter socket 10, particularly suitable for use in the lighting column previously described, with respect to FIG. 4.

The lamp adapter socket 10 comprises a casing 11 closed by a lid 12. A threaded male socket 13—similar to a lamp base—is arranged in the bottom 11*a* of the casing 11 and projects out of the casing 11. The male socket 13 is capable of being connected into a female socket 20 with which a lighting column 1*a* is equipped. The lid 12 clips onto the casing 11. It may also be adhesively bonded in order to provide complete leaktightness.

A circuit board 14*a* is arranged inside the casing. The socket 13 is electrically connected to the circuit board 14*a*. A second circuit board 14*b* is arranged in the casing 11 between the lid 12 and the circuit board 14*a*. A threaded female socket 15 is arranged in the lid 12. The circuit board 14*b* comprises strips 16 capable of providing electrical contact with a corresponding bulb 21 when the latter is screwed into the socket 15.

Consequently, the lamp adapter socket 10 is capable of being mounted in the conventional female socket of a lighting column which usually directly receives the bulb which is now accommodated by the female socket 15 of the lamp adapter socket 10. Of course, the sockets 13 and 15 may be of any suitable type other than threaded. As one embodiment, FIG. 4 proposes a lamp adapter socket in which the male socket 13 is replaced by a terminal block 13*a* placed on the outer face of the bottom 11*a* of the casing 11 and by a threaded shank 13*b* also arranged on the outer face of the bottom 11*a* to allow the lamp adapter socket 10 to be attached by means of a nut.

Figure 5:
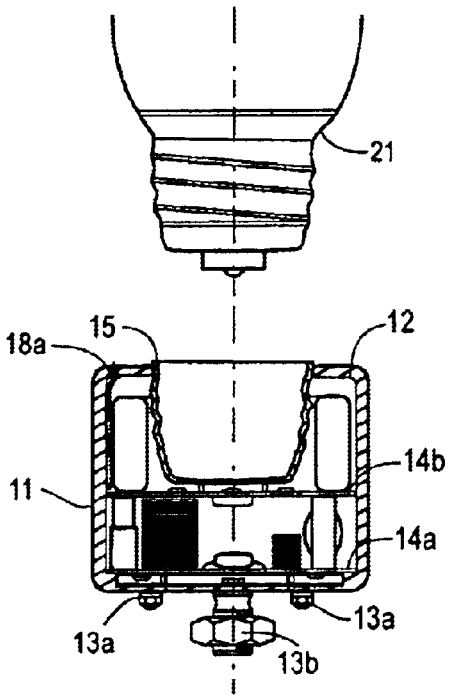
FIG. 5 illustrates one embodiment of a lamp adapter socket in section.

Both circuit boards 14*a* and 14*b* are electrically connected with each other and have the following electronic circuits, as illustrated in FIG. 5:

a radiofrequency transceiver 17;

an electronic control module with a microprocessor 18;

a switch mode power supply 19.

The transceiver 17 is interfaced with the control module 18 which manages the transceiver 17 communications. The transceiver 17 and the control module 18 are known per se. In particular, the control module 18 may comprise a memory of EEPROM type for storing an identification number for addressing within a network of street lamps. It could also include a photosensitive cell 18*a* arranged, for example, in an orifice made in the lid or in a side wall of the casing 11 in order to measure the brightness outside the casing. More generally, we recall that the control module 18 could also include a lighting column control unit which can especially fulfill one or more of the following functions:

controlling the ignition or the extinction of the lamp mounted in the socket 15 of the lamp adapter socket 10, itself mounted in a lighting column 1*a* or the like;

managing the startup of this lamp;

varying the supply power delivered to this lamp;

measuring the electric current consumed by this lamp;

determining the phase shift between the current and the voltage (cos $\phi$);

compensating for the phase shift between the current and the voltage (cos $\phi$);

measuring the temperature outside or inside the electronic module.

These functions may be implemented in a manner known per se.

Where the lighting column control unit comprises means for measuring the electric current consumed by the lamp, it may advantageously cut off the supply to the lamp of the lighting column 1 in the case of measured overload in order to make the lighting column safe. In this case, it is preferable that the starting back up of the lamp is manual or requires a command sent to the control module of the lighting column by the monitoring station.

The transceiver 17 and the control module 18 are powered by means of the socket 13 when the lamp adapter socket 10 is mounted in a corresponding female socket 20 of a street lamp or similar, which is electrically powered.

Similarly, the switch mode power supply 19 receives its energy from the socket 13 and its outputs are connected to the strips 16 in order to supply the bulb 21 when it is placed in the socket 15.

By way of example, a casing 11 having a diameter of 60 mm and a depth of 50 mm may be enough to accommodate all of the abovementioned components.

In another embodiment, the radio transceiver 17 is replaced by a transceiver which modulates line voltage.

All that is required is to mount a lamp adapter socket 10 according to the invention on a lighting column 1*a* in place of the usual bulb 21. In other words, the male socket 13 of the lamp adapter socket 10 is mounted in the female socket 20 of the lighting column 1*a* which usually receives the bulb 21, the latter being henceforth mounted in the female socket 15 of the lamp adapter socket 10.

All that is required to extinguish the lamp, for example in the first embodiment, is to open the switches D4, D5 and D6. Another possibility consists in keeping the switch D7 open. The switches D4, D5, D6 and D7 are controlled by the control module 18.

The secondary winding of the transformer may again advantageously have an additional low-voltage—for example 12 Volts—output in order to supply the transceiver 17 and the control module 18 and possibly yet other electronic circuits via a rectification and filtering circuit 22.

A person skilled in the art will understand that the switch mode power supply 19 is a module that is independent of the other elements housed in the lamp adapter socket. In particular, the switch mode power supply 19 may be used to supply a discharge lamp independently of the transceiver 17. It is thus possible to produce a lamp adapter socket having no transceiver 17, but including a switch mode power supply of the type 19 with a specific control module for controlling the various switches D4 to D7. A lamp adapter socket of this sort could especially be used where it is not desired to remotely control the lamp.

It is also possible to add only a receiver thereto instead of a transceiver in order to allow the lamp to be remotely controlled, but not to send back data relating to the operating conditions.

Of course, the present invention is not limited to the examples and to the embodiment described and shown, but it is capable of many variants accessible to a person skilled in the art.

What is claimed is:

1. A light source comprising:

a discharge lamp; and a switch mode power supply powering the discharge lamp, the switch mode power supply supplying the lamp selectively with at least one startup voltage and with a service voltage lower than the startup voltage;

wherein the switch mode power supply comprises:

voltage chopping means;

a transformer supplied by the chopping means, the transformer having a first output providing the startup voltage and a second output supplying the service voltage; and means for selectively applying the startup voltage and the service voltage to the lamp.

2. The light source as claimed in claim 1, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock; the control circuit preferably comprising a memory for storing one or more of the measurements carried out.

3. The light source of claim 1, wherein the switch mode power supply supplies the lamp with the service voltage after startup.

4. The light source of claim 3, wherein the switch mode power supply comprises means for determining the end of startup as a function of the light intensity emitted by the lamp.

5. The light source of claim 1, wherein the switch mode power supply further comprises a transceiver controlling the ignition/extinction of the lamp.

6. The light source as claimed in claim 5, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock;

the control circuit preferably comprising a memory for storing one or more of the measurements carried out.

7. The light source of claim 6, wherein the transceiver transmits the measurements from the control circuit.

8. A light source comprising:

a discharge lamp; and a switch mode power supply powering the discharge lamp, the switch mode power supply supplying the lamp selectively with at least one startup voltage and with a service voltage lower than the startup voltage;

wherein the switch mode power supply comprises:

voltage chopping means;

a transformer supplied by the chopping means, the transformer having a first output providing the startup voltage and a second output supplying the service voltage; and means for selectively applying the startup voltage and the service voltage to the lamp;

and wherein the switch mode power supply supplies the lamp with the service voltage after startup, the switch mode power supply comprising means for determining the end of startup as a function of the duration of startup voltage application.

9. The light source as claimed in claim 8, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock;

the control circuit preferably comprising a memory for storing one or more of the measurements carried out.

10. The light source of claim 8, wherein the switch mode power supply further comprises a transceiver controlling the ignition/extinction of the lamp.

11. The light source as claimed in claim 8, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock;

the control circuit preferably comprising a memory for storing one or more of the measurements carried out.

12. The light source of claim 8, wherein the switch mode power supply further comprises a transceiver controlling the ignition/extinction of the lamp.

13. The light source as claimed in claim 12, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock;

the control circuit preferably comprising a memory for storing one or more of the measurements carried out.

14. The light source as claimed in claim 12, wherein the switch mode power supply further comprises a control circuit carrying out at least one of the following measurements:

measurement of the electric current consumed by the lamp;

measurement of the external temperature or of the control circuit;

measurement of the external brightness;

measurement of the phase shift between current and voltage supplying the lamp;

measurement of external vibration;

measurement of external shock;

the control circuit preferably comprising a memory for storing one or more of the measurements carried out.

15. The light source of claim 14, wherein the transceiver transmits the measurements from the control circuit.

16. The light source of claim 14, wherein the transceiver transmits the measurements from the control circuit.

17. A light source comprising:

a discharge lamp; and a switch mode power supply powering the discharge lamp, the switch mode power supply supplying the lamp selectively with at least one startup voltage and with a service voltage lower than the startup voltage;

wherein the switch mode power supply comprises:

voltage chopping means;

a transformer supplied by the chopping means, the transformer having a first output providing the startup voltage and a second output supplying the service voltage; and means for selectively applying the startup voltage and the service voltage to the lamp;

and wherein the switch mode power supply supplies the lamp with the service voltage after startup, the switch mode power supply comprising means for determining the end of startup as a function of the current flowing through the lamp.

* * * * *